US006799760B2

(12) United States Patent
Stemmle

(10) Patent No.: US 6,799,760 B2
(45) Date of Patent: Oct. 5, 2004

(54) METHOD AND APPARATUS FOR VERTICALLY STACKING MAILPIECES VIA THE TOP OR BOTTOM OF THE STACK

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/065,288

(22) Filed: Sep. 30, 2002

(65) Prior Publication Data

US 2004/0061282 A1 Apr. 1, 2004

(51) Int. Cl.[7] ..... B65H 31/38
(52) U.S. Cl. ..... 271/207; 271/212
(58) Field of Search ..... 271/207, 212, 271/178, 179; B65H 31/38

(56) References Cited

U.S. PATENT DOCUMENTS

| | | | | |
|---|---|---|---|---|
| 4,997,337 | A | 3/1991 | Trimble | |
| 5,562,399 | A * | 10/1996 | Schulz | 414/795 |
| 5,709,525 | A | 1/1998 | Marzullo et al. | |
| 2001/0054790 | A1 * | 12/2001 | Ikeda | 271/213 |
| 2003/0184011 | A1 * | 10/2003 | Schaareman et al. | 271/207 |

* cited by examiner

*Primary Examiner*—Donald P. Walsh
*Assistant Examiner*—Kenneth W. Bower
(74) *Attorney, Agent, or Firm*—Michael J. Cummings; Charles R. Malandra, Jr.; Angelo N. Chaclas

(57) ABSTRACT

An embodiment of the present invention comprises a means for holding the stack in a tilted position, the means comprising a tilted base; a sliding retainer positioned to support a side of the stack that is tilted toward the sliding retainer by the means for holding the stack in a tilted position; a first input area positioned above retainer element; a second input area positioned below the retainer element and above the means for holding the stack in a tilted position; a second input area positioned below the retainer element and above the means for holding the stack in a tilted position; and a translating carriage means attached to the means for holding the stack in a tilted position, the translating carriage means movable in an about vertical direction in response to a control signal indicating the direction of about vertical movement; whereby the apparatus is configured to selectably add mailpieces to the top of the vertical stack via the first input area or the bottom of the vertical stack via the second input area.

7 Claims, 7 Drawing Sheets

METHOD AND APPARATUS FOR VERTICALLY STACKING MAILPIECES VIA THE TOP OR BOTTOM OF THE STACK

BACKGROUND OF INVENTION

1. Field of the Invention

The invention disclosed herein relates generally to the field of paper handling preparation and more particularly, to a stacking apparatus.

2. Background of the Invention

Mailpiece stacking devices are known for taking singulated items and forming them into stacks or columns. Stackers are commonly used in conjunction with photocopier machines, printers, facsimile machines, mailing machines, folders, folder/sealers, small envelope inserter devices, mail openers, envelope printers and labelers. In many of these applications, such as mailing machines and envelope printers, an envelope is imprinted with an address and then immediately fed into a stacker. The ink on the envelope is often not dry as the mailpiece enters the stacker. Failure of the ink to dry enables a successive envelope to smear the ink on a previous envelope in the stacker.

In order to obtain the postal rate discounts, the order of the mailpieces that have been presorted and processed by the mail-processing machine in consecutive order needs to be maintained. The removed stack of mailpieces can be manually placed in a mail tray that is sent to the postal service. In this manner, the user can take advantage of lower postal rates that are provided to users who tray envelopes according to predetermined criteria. The predetermined criteria includes the maintaining of mailpieces in the exact order in which they were processed in the mail processing machine. Generally, the predetermined criteria relates to a reduction in the postal service's handling of the mail from the mailers. The United States Postal Service ("USPS") offers several levels of discounts to mailers. The level of discount typically is based on the number of criteria met by the mailer. For example, in order to maximize such postage discounts, the USPS requires that high volume mailers presort the mailpieces, apply a ZIP+4 bar code to each mailpiece, and package their mail into trays with each tray tagged in accordance with the Domestic Mail Manual.

The instant invention relates to a method and apparatus for stacking documents to either the top or the bottom of the stack. Users of mailing machines, inserting equipment or other mail preparation devices often would like the flexibility of being able to add mailpieces to the bottom or the top of a mailpiece stack. Thus, some mail processing systems prefer top stacking in some applications and bottom stacking in other applications. For example mailing machine systems having bottom feeder for which top stacking is preferred in order to keep the mailpieces in their original order. Another example is an addressing system configured to print addresses from multiple data bases. Some of the databases may list the addresses in forward order, while others may list addresses in reverse order. It is generally preferred to stack the mailpieces in forward order. A system such as the present invention, with selectable top or bottom stacking, could accomplish this modification the database.

Another example of a system which could benefit from an output device which can selectably stack either on top or on the bottom of the stack is a meter/mailing machine combination capable of handling mixed sizes of mailpieces and selectably sealing the mail or not sealing it during the franking operation. Pitney Bowes" Paragon® and DM950™ are examples of such a system. Bottom stacking may be preferred when processing a consistently sized batch of mailpieces which need to be sealed. Since the weight of the stack is felt by the new mailpiece added to the bottom and the weight assists in sealing the new mailpiece as well as other mailpieces in the stack. Additionally, when the mailpieces have glossy surfaces (and are thus more prone to image smearing during the stacking operation than regular mailpieces), the customer may prefer bottom stacking to minimize the probability of image smearing. Top stacking may be preferred for mailpieces that have already been sealed, or for jobs having intermixed mailpiece sizes, in which case top stacking may be the only option which will handle the stacking function.

An additional problem with the prior art is that the stackers typically have large space requirements, for example power stackers typically have a long run length. For some customers, the relatively large space requirements for the stacker can inhibit sales and placements of the product.

Additional difficulty with the prior art is that vertical top stacking operations can create untidy stacking. This is because mailpieces drop a long distance to the top of the stack and often do not settle neatly on top of the stack. Some mailpieces settle on edge, or sometimes flip over, or the mailpieces end up sticking partially out of the stack. In general, the stacking operation requires operator vigilance and frequent unloading or manual tidying the stack to insure continuous operation.

Thus, one of the problems of the prior art is that an ink from an envelope can smear onto an adjacent envelope. Another problem is that it is desirable to maintain the ordered of the mailpieces being stacked. Another problem of the prior art is untidy stacking. Another problem of the prior art is the need for a large footprint. Another problem of the prior art is unavailability of selecting stacking sequence (via top or bottom). Therefore, a system and method for stacking envelopes is needed which provides decreased smearing, maintains mailpiece order, provides tidy stacking, provides a smaller footprint and allows operator selectability of stacking sequence.

SUMMARY OF INVENTION

This invention overcomes the disadvantages of the prior art by providing an apparatus and method for stacking mailpieces. In particular, an embodiment of the present invention is an operator selectable top or bottom stacking apparatus that arrays the stack of mailpieces in a vertical orientation, increases the stacker capacity while reducing the footprint, and improves the tidiness of the stacking when either the top or bottom stacking feature has been selected. The bottom stacking feature of this invention reduces sliding contact with other mailpieces or portions of the stacker mechanism for portions of the mailpiece that are likely to be recently imaged, thus reducing the possibility of smeared images. It enhances sealing since recently stacked mailpieces feel the weight of the stack. And it enables simple unload while running capability without operator skill and without shutting down the system in the middle of a job. The top stacking feature adds further benefits such as enabling stacking of mixed mail sizes, and it improving the tidiness and reliability of the top stacking function by maintaining a preferred minimum dropping distances for mailpieces added to the top of the stack.

An embodiment of the present invention comprises an apparatus for stacking mailpieces in a vertical stack. The apparatus includes a means for holding the stack in a tilted position, the means comprising a tilted base. A sliding retainer is positioned to support a side of the stack that is tilted toward the sliding retainer by the means for holding the stack in a tilted position. A first input area is positioned above retainer element and a second input area is positioned below the retainer element and above the means for holding the stack in a tilted position. A translating carriage means is attached to the means for holding the stack in a tilted position, the translating carriage means is movable in an approximately or about vertical direction in response to a control signal indicating the direction of about vertical movement; whereby the apparatus is configured to selectably add mailpieces to the top of the vertical stack via the first input area or the bottom of the vertical stack via the second input area. It is further contemplated that the apparatus may be tilted a predetermined magnitude.

In another embodiment, the present invention comprises a method of stacking mailpieces in a vertical stack, the method comprising: a) providing a means for holding the stack in a tilted position; b) delivering mailpieces to the top of the stack; c) detecting whether the top of the stack has reached a predetermined height; d) lowering incrementally the means for holding the stack in a tilted position to a predetermined position that will provide the means for holding the stack in a tilted position space to accept additional mailpieces. The method further comprises e) detecting whether the top of the stack has reached another predetermined height indicating that a portion of the stack has been removed from the means for holding the stack in a tilted position; and f) raising the means for holding the stack in a tilted position to a predetermined position that provides a preferred dropping distance for mailpieces that are added to the stack.

An advantage of the present invention is that it decreases image smearing, reduces stacker footprint, improves sealing, provides ordered stacking regardless of the order of the input of the elements, such as, for example, mailpieces (i.e., stacks in 1 to N order), an operator selectable top or bottom stacking apparatus that arrays the stack of mailpieces in a vertical orientation, improves the tidiness of the stacking when either the top or bottom stacking feature has been selected, enables simple unload while running capability and could be unloaded during the processing of a job, and, without shutting down the system in the middle of a job, enables stacking of mixed mail sizes, and it improves the tidiness and reliability of the top stacking function by maintaining a preferred minimum dropping distances for mailpieces added to the top of the stack. Other advantages of the invention will in part be obvious and will in part be apparent from the specification. The aforementioned advantages are illustrative of the advantages of the present invention.

BRIEF DESCRIPTION OF DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION

Figure 1:
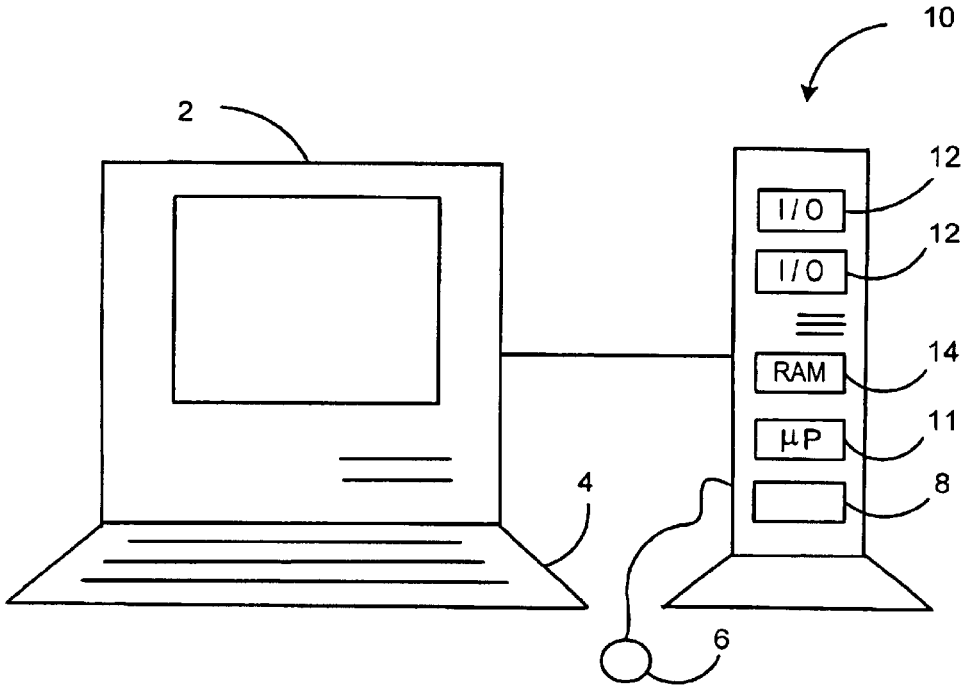
FIG. 1 is a block diagram that illustrates a computer system 100, the use of which an embodiment of the invention may be implemented.

In describing the present invention, reference will be made herein to FIGS. 1–5 of the drawings, in which like numerals refer to like features of the invention. Features of the invention are not necessarily shown to scale in the drawings.

Control Overview

FIG. 1 is a block diagram that illustrates a computer system 10, the use of which an embodiment of the invention may be implemented. Computer system 10 may be a personal computer which is used generically and refers to present and future microprocessing systems with at least one processor operatively coupled to user interface means, such as a display 2 and keyboard 4 and/or a cursor control, such as a mouse or a trackball 6, and storage media 8. The personal computer 10 may be a workstation that is accessible by more than one user. The personal computer also includes a conventional processor 11, such as a Pentium® microprocessor manufactured by Intel, and conventional memory devices such as hard drive 8, floppy or CDRW drive(s) 12, and memory 14.

Figure 2:
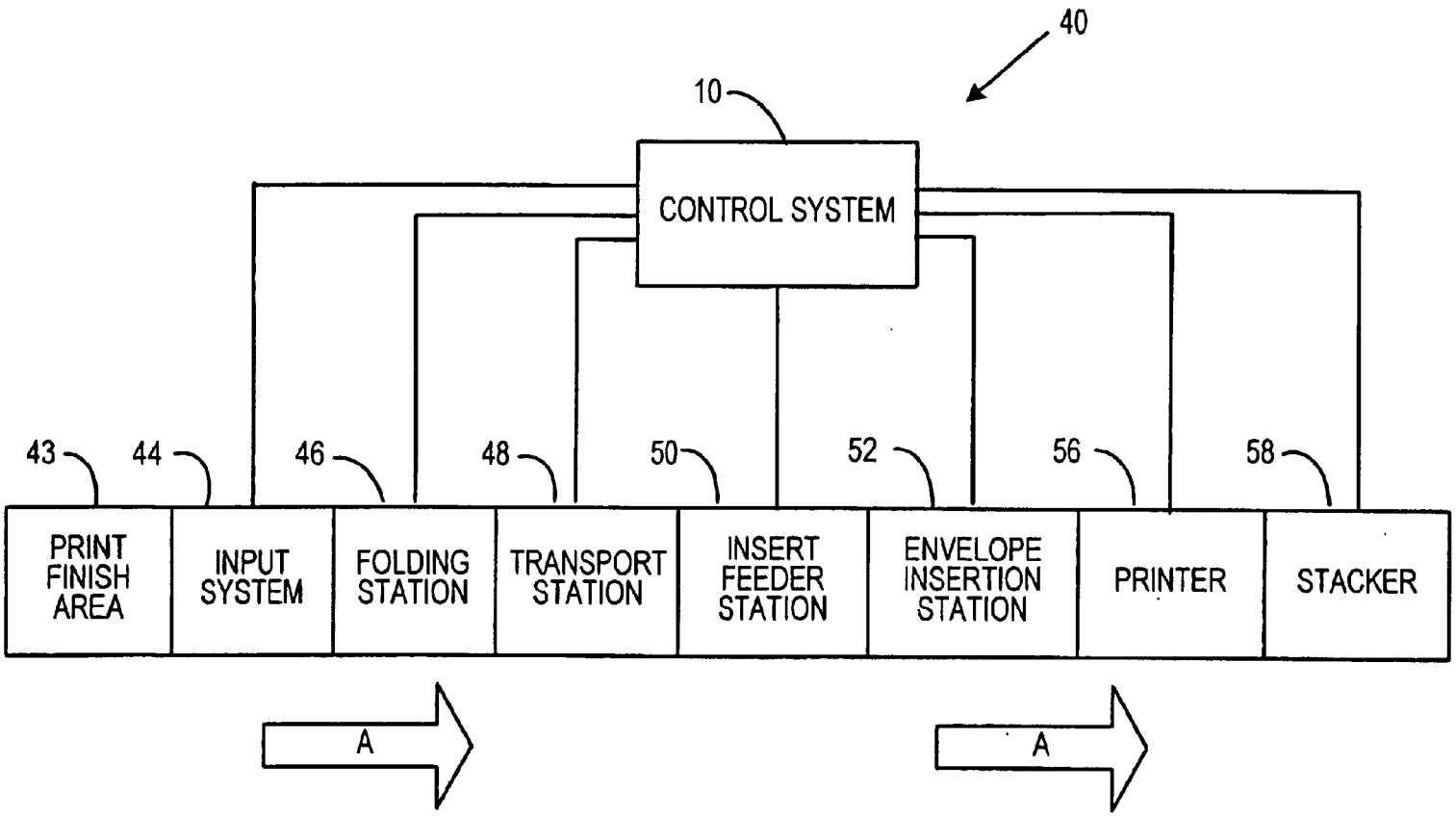
FIG. 2 is a block diagram schematic of a typical document inserter system.

The computer system 10 can be connected to an inserter apparatus as illustrated in FIG. 2. The control system 10 of the inserter system 40 may be the microprocessor-based personal computer system 10 described above. The computer system 10 includes appropriate memory devices 8, 14 for storage of information such as an address database (not shown). One of ordinary skill in the art would be familiar with the general components of the inserter system with which the present invention may be implemented.

Document Inserter System Overview

The stacker apparatus 58 of the present invention may be part of a document inserter system 40. FIG. 2 is a schematic of a typical document inserter system 40, generally designated 40. In the following description, numerous paper handling stations implemented in inserter system 40 are set forth to provide a thorough understanding of the operating environment of the inserter. However it will become apparent to one skilled in the art that the present invention may be practiced without the specific details of these paper-handling stations.

As will be described in greater detail below, system 40 preferably includes an input system 44 that feeds paper sheets from a paper web or individual sheets (not shown) to an accumulating station that accumulates the sheets of paper in collation packets (not shown). In this particular example, the apparatus of the present invention provides envelope throat profile information to the control system 10 of inserter system 40 to control the opening of various sized envelopes in the mailing inserter system 40. Alternate methods of inserting include printing the address on the insert document only and inserting such document into a window envelope which reveals the address, printing the documents in a print finishing 43 area upstream from the input system 44 of document inserter system 40 and feeding the documents directly to the input system 40 from the print finishing area 43.

Typically, input system 44 feeds sheets in a paper path, as indicated by arrow A along a deck that is commonly called the main deck (not shown) of inserter system 40. After sheets are accumulated into collations by input system 44, the collations are folded in folding station 46 and the folded collations are then conveyed to a transport station 48, preferably operative to perform buffering operations for maintaining a proper timing scheme for the processing of documents in inserter system 40.

Each sheet collation is fed from transport station 48 to insert feeder station 50. It is to be appreciated that a typical inserter system 40 includes a plurality of feeder stations, but for clarity of illustration only a single insert feeder 50 is shown. Insert feeder station 50 is operational to convey an insert (e.g., an advertisement, business reply envelopes, or other documents or documentation) from a supply tray to the main deck of inserter system 40 so as to be nested with the aforesaid sheet collation being conveyed along the main deck. The sheet collation, along with the nested insert(s), are next conveyed into an envelope insertion station 52 that is operative to insert the collation into an envelope. The envelope is conveyed to the printer station 56 where appropriate printing such as addressee information and/or postal indicia is applied on an exterior surface of the envelope. Finally, the envelope is conveyed to stacker apparatus 58 that stacks the envelopes in accordance with the present invention.

The use of the document inserter system 40, such as, for example, a Series 9 Inserter Systems manufactured by Pitney Bowes Inc. of Stamford, Conn., is well known. Such document inserter systems are used by organizations (e.g., banking institutions, utility companies, insurance companies, credit companies, and the like) for assembling large amounts of outgoing mailpieces for dispatch through the postal system. Typically, such organizations create documents, such as billing documents in a computer such as a mainframe computer system (not shown) that is separate from the document inserter system 40 that will process the documents into such mailpieces.

Stacker Apparatus

The stacking apparatus 58 of the present invention is configured to selectably stack from either the top or the bottom of the stack and is capable of handling mixed sizes of mailpieces. Bottom stacking may be preferred when processing a consistently sized batch of mailpieces which need to be sealed, since the bottom stacker 58 enhances sealing by ensuring that the weight of the stack is felt by each new mailpiece as it is added to the bottom of the stack. Additionally, when the mailpieces have glossy surfaces (and are thus more prone to image smearing during the stacking operation than are regular mailpieces), the user or operator may prefer bottom stacking to minimize the probability of image smearing. Top stacking may be preferred for mailpieces that have already been sealed (in which case the sealing enhancement feature of bottom stacking is not needed), or top stacking may be preferred for mail creation jobs having intermixed mailpiece sizes (in which case top stacking may be the only option which could handle the stacking function).

Figure 3:
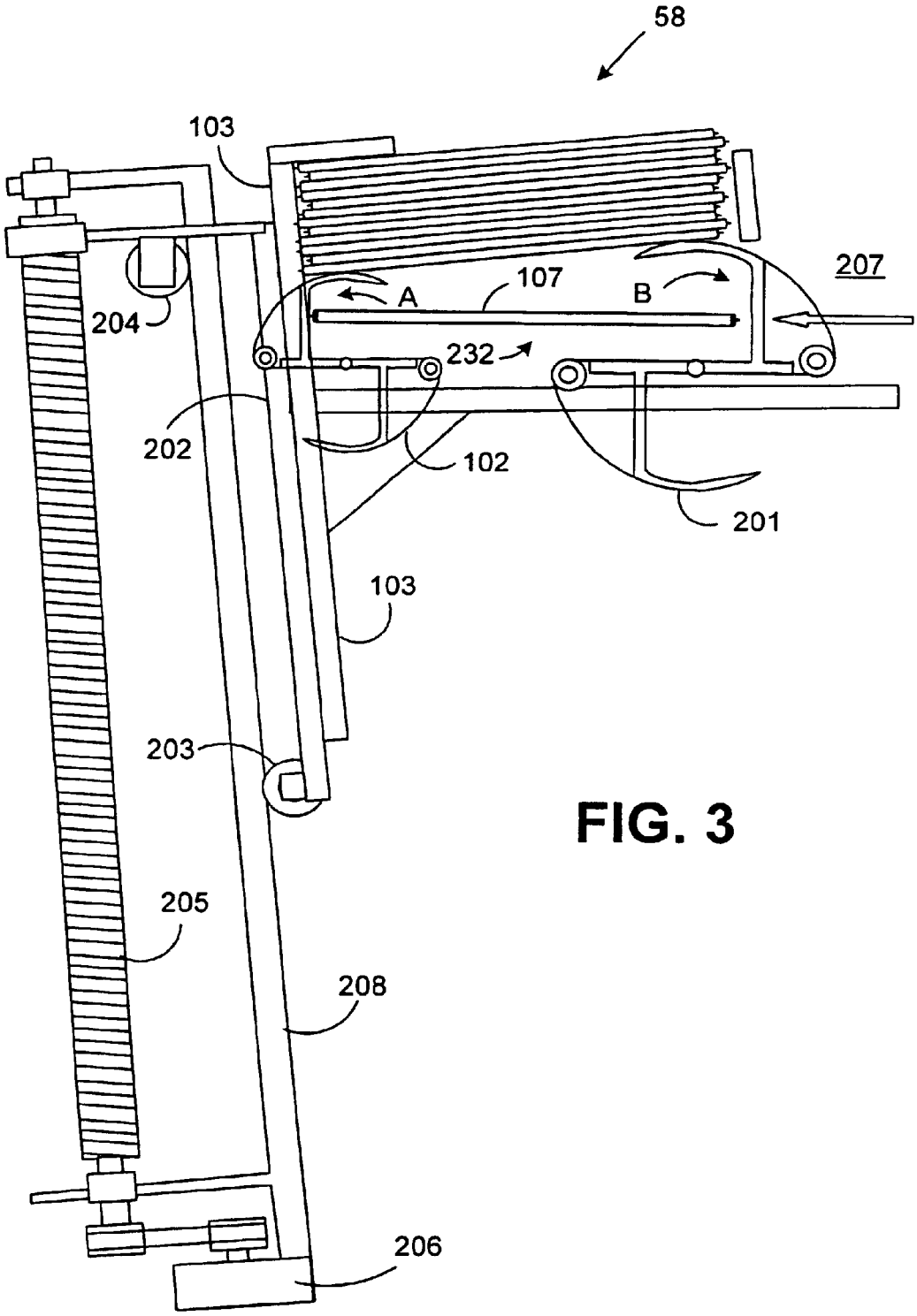
FIG. 3 is a partial side view of an embodiment of the stacking device of the present invention configured to bottom stack and also illustrating a sliding retainer and translating carriage.

FIG. 3 is a partial side view of an embodiment of the stacking device of the present invention configured to bottom stack and also illustrating a sliding retainer and translating carriage. The stacking mechanism is positioned such that input area 232 is positioned below the retainer element and above the means for holding the stack in a tilted position. For bottom stacking two intermittently rotating S-elements 201, 102, at least one stack guide element 103 and appropriate drive elements (not shown) rotate the rotating S-elements. Further, means are included to move one of the two rotating S-elements 201 into a position consistent with the size of the mailpieces to be stacked while leaving the second rotating S-element 102 fixed. This operation can be automated with the use of appropriate sensors and drive elements. Alternatively, this operation may be manual.

Figure 4:
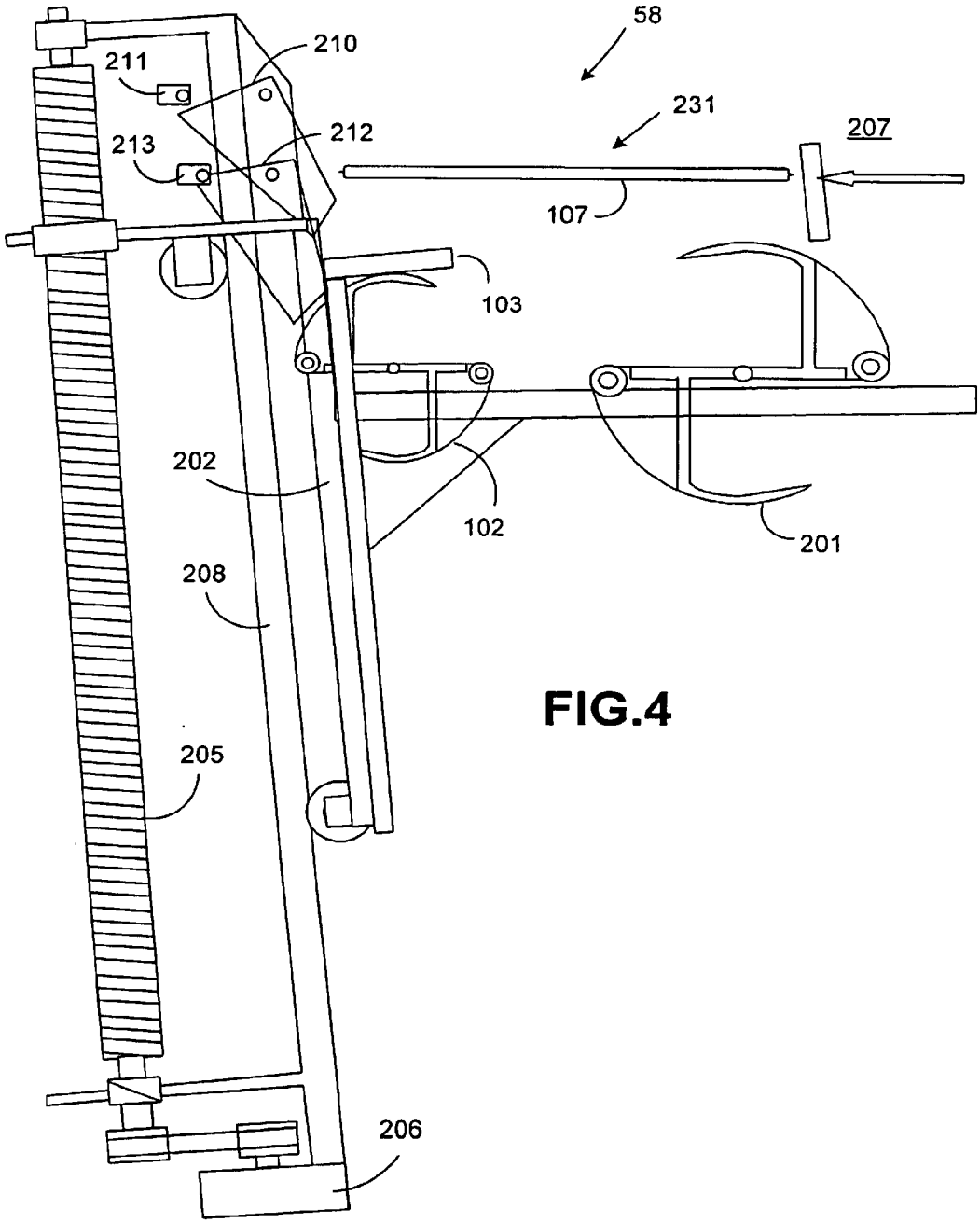
FIG. 4 is a partial side view of an embodiment of the stacking device of the present invention configured to top stack illustrating sensors used for control of the movement of the carriage.

FIG. 4 is a partial side view of an embodiment of the stacking device of the present invention configured to top stack, also illustrating sensors used for control of the movement of the carriage. FIG. 4 illustrates the position of the carriage 202 for receiving first mailpiece 107 to be stacked on top of the S-elements, which are configured for holding the stack in a tilted position. The carriage 202 is positioned below input area 232 in order to receive mailpieces 107 on top of the stack. The embodiment comprises a carriage 202 and lead screw elements 205. In this arrangement, the S-elements 102 and 201, associated drives (not shown), and the sliding retainer element 103 are mounted on a translating carriage 202, which is capable of being driven in a slightly off-vertical direction by a lead screw 205 activated by a lead screw motor 206. The lead screw 205, motor 206, and associated bearings and drives are suitably mounted to fixed frame 208. For bottom stacking operation, the carriage 202 is first positioned so that individual mailpieces 107 enter the stacker 58 just above the shelf areas of the S-elements. Thereafter, the carriage 202 and lead screw 205 remain substantially stationary while stacker 58 is in operation. The S-elements 102 and 201 rotate, for example, up to 180 degrees after each mailpiece 107 enters, thus lifting the individual mailpiece 107 to the bottom of the stack. The stack grows in an approximately vertical direction as more mailpieces are added to the stack. Note that the S-element 201 of the present embodiment is larger than the S-element 102. The differently sized S-elements create a slight tilt of the stack against the sliding retainer element 103 to help support of tall stacks. Alternately, the two S-elements could be the same size, and the frame could be tipped further in order to tilt the stack. The sliding retainer element 103 (shown in FIG. 3 with an elongated vertical element roughly equal to the maximum stack height) rests on the top of the stack and assists in sealing and in keeping the stacked mailpieces tidy as the stack grows in the approximately vertical direction.

Note the mailpiece input position 207 in FIG. 4 remains at the same location as shown in FIGS. 3 and 5 (described herein). FIG. 4 is a partial side view of an embodiment of the stacking device of the present invention configured to top stack illustrating sensors used for control of the movement of the carriage. FIG. 4 illustrates the carriage 202 repositioned down, for example, a few inches from the position shown in FIG. 3, to a position suitable for the beginning of top stacking operation. For the top stacking operation of the present embodiment, the S-elements 102 and 201 do not rotate, and the mailpieces are stacked on top of the S-elements 102, 201 and the sliding retainer 103. As the stack grows with repeated stacking of new mailpieces, the carriage 202 moves downward to keep a relatively constant drop distance for the new mailpieces.

Figure 5A:
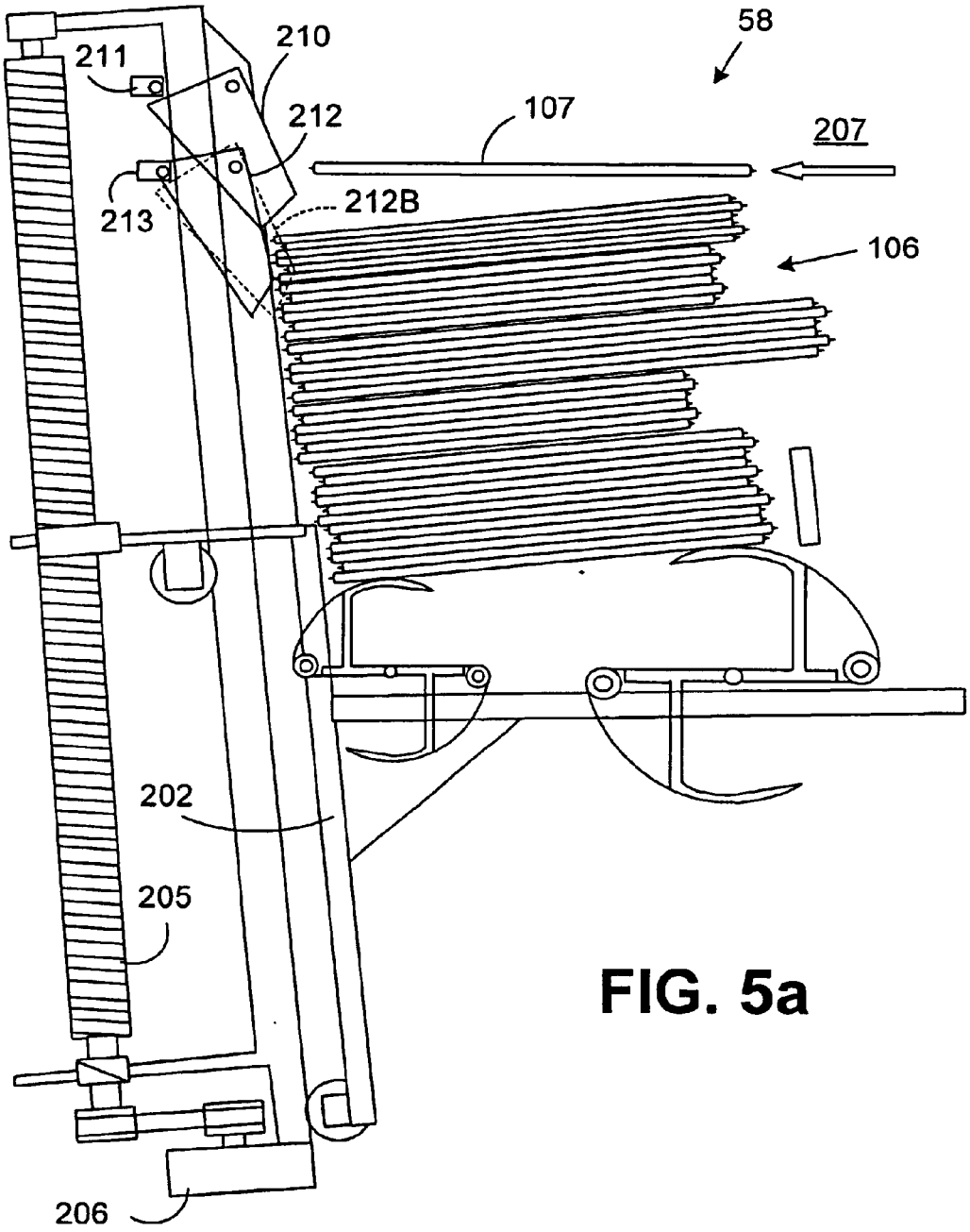
FIG. 5*a* is a partial side view of an embodiment of the stacking device of the present invention configured to top stack, illustrating the carriage position after a stack has accumulated and the carriage has appropriately moved downward as the stack accumulates, and also illustrating sensors used for control of the movement of the carriage.

FIG. 5*a* is a partial side view of an embodiment of the stacking device of the present invention configured to top stack, illustrating the carriage position after a stack has accumulated and the carriage has appropriately moved downward as the stack accumulates. In the embodiment of FIG. 5, two sensor systems are used to control the position of the carriage 202 to help the top of the stack remain in the preferred position of 1 to 2 inches below the mailpiece input position during active top stacking operation. The sensor scheme illustrated in this embodiment is not meant to be limiting; other sensor schemes as may be determined by one of ordinary skill in the art can also accomplish the sensing function. The sensor arrangement of the present embodiment comprises a first optical sensor 211 and first rotating flag 210 which operate to determine when the mailpieces in the stack have accumulated to a predetermined height. As is further illustrated in FIG. 5*a*, a second flag 212 and second optical sensor 213 are positioned to detect when an operator has removed a portion of the stack 106.

Figure 5B:
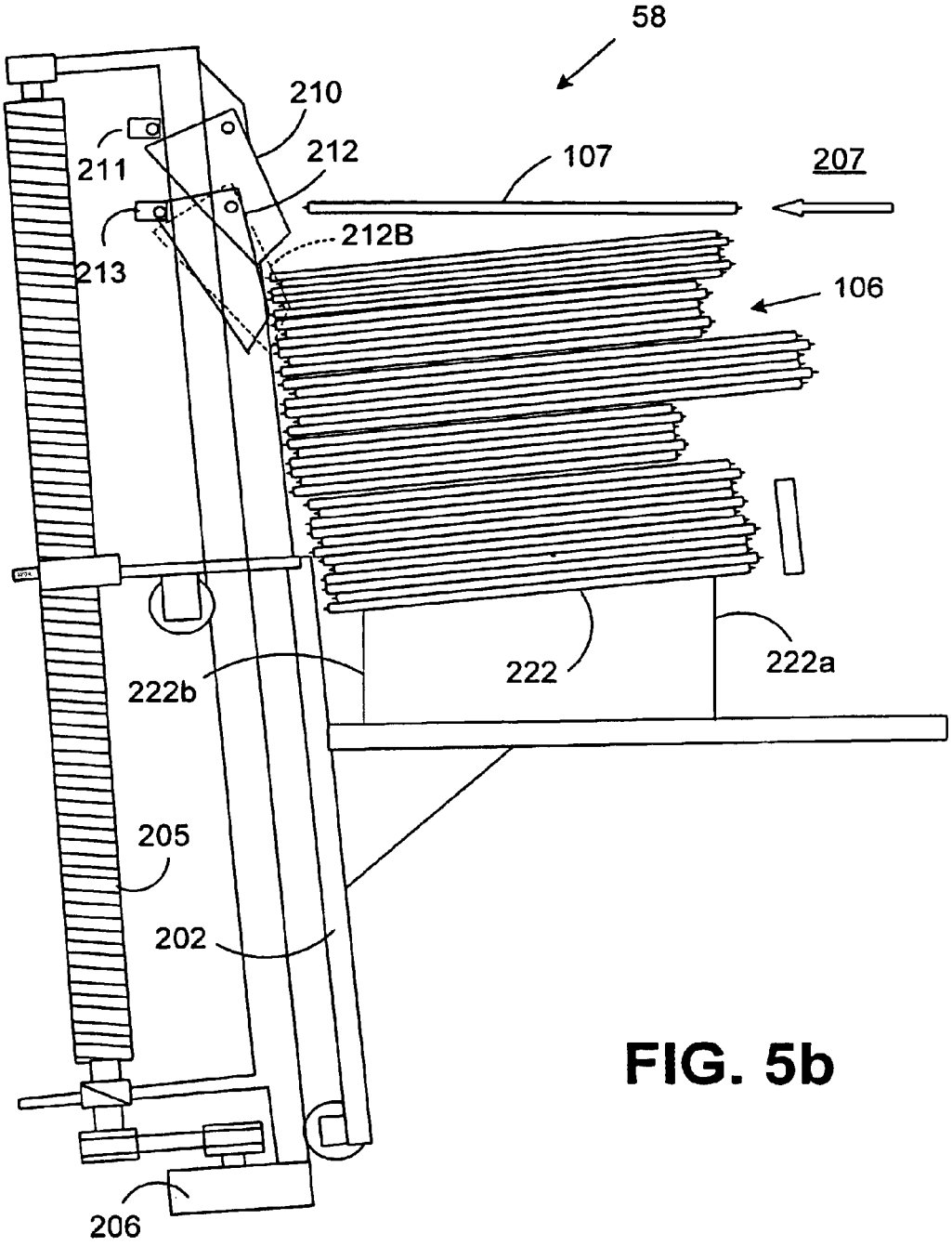
FIG. 5*b* is a partial side view of an embodiment of the stacking device of the present invention configured to top stack, illustrating the carriage position after a stack has accumulated and the carriage has appropriately moved downward as the stack accumulates, and also illustrating an angled planar surface for supporting the stack.

FIG. 5*b* is a partial side view of an alternate embodiment of the stacking device of the present invention configured to top stack, illustrating the carriage 202 position after a stack 106 has accumulated and the carriage 202 has appropriately moved downward as the stack 106 accumulates and also illustrating an angled planar surface 222 for supporting the stack. As is shown in FIG. 5*b*, the planar surface 222 is inclined toward the translating carriage means. The incline is achieved by configuring a first side 222*a* of the planar surface 222 at a height greater than the height of a second side 222*b* of the planar surface 222*a*. FIG. 5*b* also illustrates that carriage may be moved such that the input location remains constant whether a top stacker or bottom stacker is used. Alternatively, as will be apparent to one skilled in the art in view of FIG. 5*b*, two separate input areas may be used with the present invention.

Figure 5C:
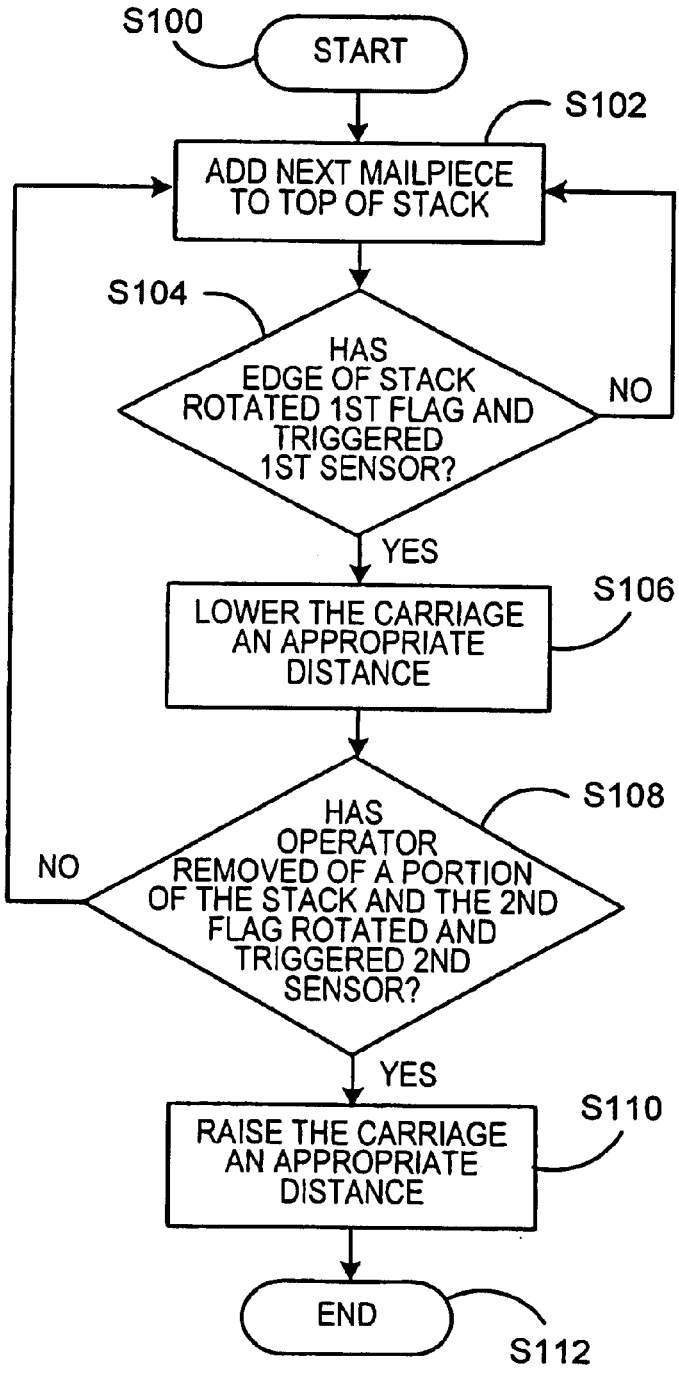
FIG. 5*c* is a flow chart illustrating the steps of the operation of the sensors and movement of the carriage during top stacking.

FIG. 5*c* is a flow chart illustrating the steps of the operation of the sensors and movement of the carriage during top stacking. At step S100, the method begins. At step S102, a mailpiece is added to the top of the stack. At step S104, a query is made as to whether the edge of the stack has caused the first flag 210 to rotate and break the beam of the first optical sensor 211. If the answer to the query of step S104 is yes, meaning that the edge of the stack has caused the flag 210 to rotate and thus break the optical sensor 211 beam, then at step S106 the carriage 202 is lowered. The lowering of the carriage for step S106 takes place when the optical sensor 211 beam is broken, and a signal is made (by control system 10) to the lead screw drive motor 206 to rotate the lead screw 205 to drop the carriage 202 by a suitable amount (preferably about 1 inch) to make space for additional mailpieces to be added to the top of the stack. If the answer to the query of step S104 is no, then steps S102 through S104 are repeated as described above.

Following step S106, at step S108 a query is made as to whether the operator has removed a portion of the stack 106 and the second flag 212 has rotated and triggered the second sensor 213. During the stacking operation the carriage 202 appropriately moves downward in small increments or steps as the stack 106 accumulates. First flag 212 is typically in contact with the edge of the stack 106 during normal stacking operation, and in that contact position, it breaks the beam of second sensor 213. When the operator removes a portion of the stack 106, as in step S108 (when the answer to the query is yes), the drop distance for new mailpieces 107 is greater than the preferred 1 to 2 inches. The second flag 212 works with the second sensor 213 to detect that the operator has removed a portion of the stack 106 by pivoting to the dashed position 212B, and exposing the optical beam of sensor 213. Next at step S110 the carriage is raised. The method of raising the carriage is preferably performed by the sensor sending a signal to control system 10 to cause lead screw motor 206 to operate in reverse and drive the carriage 202 in an upward direction until the remaining stack 106, or a feature on the carriage 202 (not shown) engages the flag 212 and rotates the flag 212 to block the optical beam 213 again, at which time the carriage 202 motion stops and the top of the stack 106 is in position to receive additional mailpieces with a minimal drop distance. Note this same sensor is used to position the carriage 202 back to a position just below the mailpiece input position 207 (as shown in FIG. 4) after the mail creation/stacking job is completed and the operator removes all mailpieces from the stacker. In this embodiment, it is a feature on the carriage 202 (and not the stacked mailpieces 106) that engages the flag 212 and positions it to break the beam of second sensor 213. At step S112, the method ends.

The embodiments described herein can provide the advantages such as decreased image smearing, reduced stacker footprint, improved sealing, ordered stacking, operator selectable top or bottom stacking, unloading while running capability, stacking of mixed mail sizes and tidiness and reliability of the top stacking function. While the present invention has been disclosed and described with reference to a various embodiments thereof, it will be apparent, as noted above, that variations and modifications may be made therein. It is, thus, intended in the following claims to cover each variation and modification that falls within the true spirit and scope of the present invention.

What is claimed is:

1. An apparatus for stacking material pieces in a vertical stack, the apparatus comprising:

a means for holding the stack in a tilted position;

a sliding retainer positioned to support a side of the stack that is tilted toward the sliding retainer by the means for holding the stack in a tilted position;

a first input area positioned above the stack;

a second input area positioned below the stack; and a translating carriage means attached to the means for holding the stack in a tilted position, the translating carriage means movable in an about vertical direction in response to a control signal indicating the direction of about vertical movement;

whereby the apparatus is configured to selectably add material pieces to the top of the vertical stack via the first input area or the bottom of the vertical stack via the second input area.

2. The apparatus as claimed in claim 1 wherein the control signal indicating the direction of the about vertical movement of the translating carriage means is the result of data provided by first and second sensors positioned in an area of the apparatus suitable for detecting desired stack height.

3. The apparatus as claimed in claim 2 wherein the first sensor operates to determine whether the carriage needs to be moved in an about vertical downward direction in order to make room for additional material pieces on the top of the stack.

4. The apparatus as claimed in claim 2 wherein the second sensor operates to determine whether the carriage needs to be moved in an about vertical direction upward in order to position the means for holding the stack to receive additional material pieces with a minimal drop distance from the first input position.

5. The apparatus as claimed in claim 1 wherein the means for holding the stack in a tilted position comprises a first S element of a first diameter and a second s element of a second diameter, the second diameter larger than the first diameter and the first s element position proximately to the translating carriage means, the second s element positioned distally to the translating carriage means, whereby the size and positioning of the first and second S-elements causes a tilt of the means for holding the stack in a tilted position toward the translating carriage means.

6. The apparatus as claimed in claim 1 wherein the means for holding the stack in a tilted position comprises a planar surface with an incline sloped toward the translating carriage means.

7. The apparatus as claimed in claim 1, wherein the apparatus is tilted a predetermined magnitude.

* * * * *